United States Patent [19]

Kähkipuro et al.

[11] Patent Number: 4,635,320

[45] Date of Patent: Jan. 13, 1987

[54] FLOOR SELECTOR FOR LIFT

[75] Inventors: Matti Kähkipuro; Pekka Häkkinen, both of Hyvinkää , Finland

[73] Assignee: Elevator GmbH, Baar, Switzerland

[21] Appl. No.: 713,390

[22] PCT Filed: Dec. 20, 1983

[86] PCT No.: PCT/FI83/00080

§ 371 Date: Mar. 11, 1985

§ 102(e) Date: Mar. 11, 1985

[87] PCT Pub. No.: WO85/02832

PCT Pub. Date: Jul. 4, 1985

[51] Int. Cl.[4] ..... B66B 3/02

[52] U.S. Cl. ..... 187/29 R; 340/21

[58] Field of Search ..... 187/29; 340/19, 21

[56] References Cited

U.S. PATENT DOCUMENTS

| | | | |
|---|---|---|---|
| 3,773,146 | 11/1973 | Dixon, Jr. et al. | 182/29 R |
| 4,068,741 | 1/1978 | Ficheux et al. | 187/29 R |
| 4,150,734 | 4/1979 | Ohira et al. | 187/29 R |
| 4,387,436 | 6/1983 | Katayama et al. | 340/21 X |

*Primary Examiner*—William M. Shoop, Jr.

*Assistant Examiner*—W. E. Duncanson, Jr.

*Attorney, Agent, or Firm*—Browdy and Neimark

[57] ABSTRACT

A pulse floor selector for a lift, with a floor and location determining system based on counting pulses indicating the lift's velocity, with the aid of electronics thereto appropriate. Dense pulse floor selection is used for determining the lift's location, in particular in modern high speed lifts. To serve as pulse former, generally a pulse transmitter (PA) mechanically coupled with the motor is required, which supplies a number of pulses (PT) proportional to the distance traversed. The present invention represents a different approach wherein the requisite pulses are formed without transmitter. In the means of the invention, there has been connected to the tachometer generator (TG) giving the velocity of the lift, an analog/digital converter (A/D) which delivers to the electronics taking care of floor and location determination, a pulse train (PT) of which the frequency is proportional to the lift's velocity, whereby the total number of pulses per time unit is thus proportional to the distance travelled. In this manner, the pulse transmitter system (PP,PT) can be simply replaced by an IC circuit (A/D).

1 Claim, 2 Drawing Figures

FLOOR SELECTOR FOR LIFT

Figure 1:
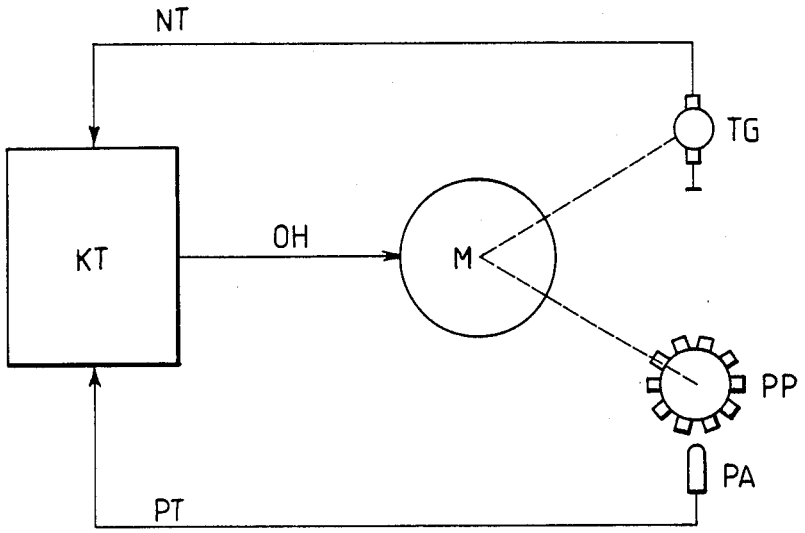

The present invention concerns a pulse floor selector for a lift, with a floor and location determining system based on counting pulses indicating the velocity of the lift, with the aid of electronics suited to the purpose.

It has become increasingly common in the course of development of digital techniques to determine the location of a lift by counting pulses supplied by a transmitter of one kind or another. The pulse counting processes can be classified by two main categories: sparse pulse floor selection, and dense pulse floor selection. Sparse pulse floor selection is based on stopping points existing in the lift shaft and on having the retardation starting points set in the shaft e.g. by means of sheet metal ramps. Switches detecting these ramps are moving along with the lift cage. The logics on the lift's control panel deduce from this information the forming of lift velocity and the floor data. A sparse pulse floor selector is particularly appropriate in connection with slow lifts. The dense pulse floor selector counts pulses all the time, based on some kind of transmitter. The lift shaft is thus measured with an accuracy of for instance one centimeter. It is particularly after the introduction of microprocessors that the dense pulse floor selector has turned out to be a convenient means for providing a floor selector. However, the dense pulse floor selector needs a transmitter in order to be operable. As a rule, this transmitter is a digital pulse-forming means which has been coupled with the motion of the lift.

By U.S. Pat. No. 4,150,734 has been patented an apparatus where in the location of the lift is calculated from the tachometer with the aid of a pulse generation during the deceleration run. A speed reference is formed from this information. In this design the forming of the actual floor-level information is not taken into consideration: this matter is assumed to be understood. It should be noted that a design operating according to this principle cannot in any way correct the errors accumulating in the deceleration distance data. This causes unsatisfactory operation of the apparatus. Therefore, the apparatus has in fact only been described in conjunction with a gearless lift, in which case the velocities are at the most 1,8 m/s and the deceleration distances 1,6 m. On deceleration runs longer than this, difficulties pile up. Express lifts operate with deceleration distances up to 18 m.

The invention presents a procedure by which the separate transmitter required in a dense pulse floor selector can be omitted and the above-mentioned drawbacks eliminated. In order to achieve the effect stated, the invention is characterized in that the said counting pulses required for floor section are formed from the tachometer generator with the aid of an analog/digital converter, and that the floor datum is corrected by the aid of information obtained from the lift shaft at the floor level.

The design solution of our invention saves the lift location datum all the time because application of a microprocessor affords an easy way to correct the floor level data at every floor level. This means that every 3 meters there is a point wher correction is made.

The invention is described in the following with the aid of an example, referring to the attached drawing, where in FIG. 1 presents the pulse floor selection arrangement commonly known in the art.

Figure 2:
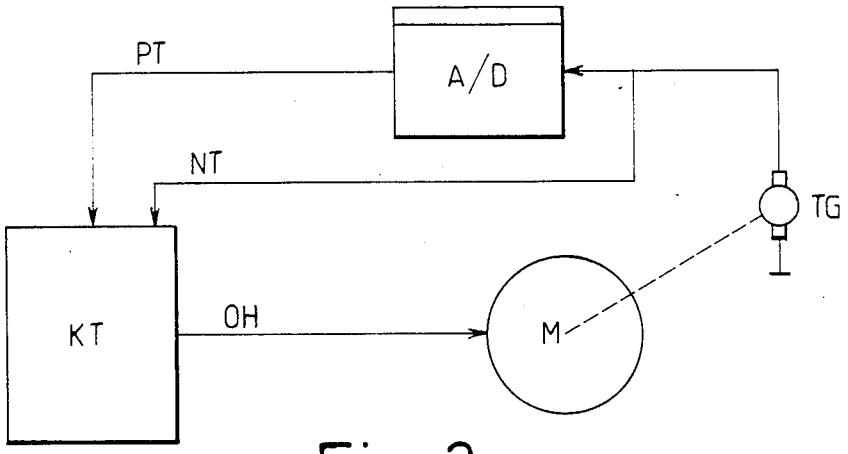

FIG. 2 presents a pulse floor selector according to the invention.

Referring now to FIG. 1, the lift motor M therein depicted is controlled by the control panel KT by the aid of electrical control data OH. With the motor has been mechanically coupled a tachometer generator TG, which supplies the velocity datum NT which the control panel requires. To the motor has also been connedted a toothed wheel PP which delivers pulses by mediation of a pulse transmitter PA. The pulses go in the form of pulse data PT to the control panel KT.

FIG. 2 shows the pulse floor selector according to the present invention. When the lift is in motion, the control panel KT controls the lift motor over the control OH. The tachometer generator TG mechanically coupled to the motor supplies a voltage which is proportional to the motor's speed of rotation. This voltage controls an analog/digital converter A/D and, directly, the control panel KT. The analog/digital converter further supplies the pulses PT required by the dense pulse floor selector system. The pulses are formed in that the analog/digital converter A/D integrates the d.c. voltage NT supplied by the tachometer generator TG, with respect to time the pulse frequency being directly proportional to the voltage NT, which in its turn is proportional to the velocity, whence follows that the number of pulses gives the distance travelled during a given time interval, according to the equation $s=vt$.

As the lift approaches the floor level which is the goal, the door area sensor elements operate in accordance which prior art.

The information NT supplied by the tachometer generator TG changes, and as the lift decelerates the data go as velocity data to the control panel KT and to the analog/digital conventer A/D. When the voltage from the tachometer generator TG decreases, the frequency of the pulse train PT from the analog/digital converter A/D correspondingly decreases. Owing to the characteristics of the tachometer generator TG, a minor location error accumulates in the calculation of location, its order of magnitude being on 1%. Since the systems comprises a microcomputer, it is possible to correct this error by making use of means indicating the floor location which are provided at the particular floor—ramps of some kind, which furnish the true immobile floor data. Such a ramp already exists in the shaft owing to the safety regulations.

What is claimed is:

1. Pulse floor selector for a lift, with a floor and location determining system based on counting pulses which indicate the lift's velocity, with the aid of electronics appropriate for this purpose, characterized in that the said counting pulses (PT) required for floor selection are formed from the tachometer generator (TG) with the aid of an analog/digital converter (A/D), and that the floor datum is corrected by the aid of information obtained from the lift shaft at the floor level.

* * * * *